United States Patent [19]

Greenawalt

[11] Patent Number: 4,528,705

[45] Date of Patent: Jul. 16, 1985

[54] COMPOSITE PILLOW

[76] Inventor: Monte H. Greenawalt, 45 McClellan Blvd., Davenport, Iowa 52803

[21] Appl. No.: 535,008

[22] Filed: Sep. 23, 1983

[51] Int. Cl.[3] ..... A47C 27/10

[52] U.S. Cl. ..... 5/441; 5/434; 5/442; 5/437

[58] Field of Search ..... 5/434, 435, 436, 437, 5/441, 442, 490

[56] References Cited

U.S. PATENT DOCUMENTS

| | | | |
|---|---|---|---|
| 655,087 | 7/1900 | Jones . | |
| 2,880,428 | 4/1959 | Forsland . | |
| 3,261,035 | 7/1966 | Slocum | 5/436 |
| 3,388,408 | 6/1968 | Blaney | 5/436 |
| 3,521,310 | 7/1970 | Greenawalt . | |
| 4,424,599 | 1/1984 | Hannouche | 5/434 |
| 4,432,107 | 2/1984 | Clark et al. | 5/434 |

FOREIGN PATENT DOCUMENTS

| | | | |
|---|---|---|---|
| 898256 | 6/1962 | United Kingdom | 5/434 |

*Primary Examiner*—Gary L. Smith
*Assistant Examiner*—Michael F. Trettel
*Attorney, Agent, or Firm*—Henderson & Sturm

[57] ABSTRACT

A composite pillow made up of a sheet of foamed material shaped into sleeve-like form with limited-area portions contacting and adhered to each other to give the pillow a shape somewhat of a pear lying on its side; i.e., with the lengthwise axis of the pear being horizontal. The sleeve-like sheet provides a peripheral wall within which a fairly large cavity exists to one side of the junction between the joined areas, and this cavity contains an air bag or the like which may be selectively inflated to provide support for the user's neck while the user's head rests on the small part of the "pear".

8 Claims, 5 Drawing Figures

COMPOSITE PILLOW

BACKGROUND AND SUMMARY OF THE INVENTION

Pillows of various types are known, designed to provodie for support of the neck and head of a person lying face up, the end purpose being that the neck and head are supported generally in the respective positions that they would occupy when the person is standing, as distinguished from the conventional bed pillow in which the head is elevated and the neck is bent and thus uncomfortably stressed. In general, such improved pillows have as a fundamental structural feature a relatively firm portion for supporting the neck and an adjacent relatively soft portion for receiving the head. One such pillow forms the subject matter of the United States patent to Greenawalt, U.S. Pat. No. 3,521,310, wherein is depicted a three-piece pillow having a central resilient portion flanked by opposite side portions, the pieces being laminated together to form the complete pillow. Each side portion is relatively firm and the central portion is relatively soft. Another United States patent is that to Forsland, U.S. Pat. No. 2,880,428, showing a generally wedge-shaped pillow with a larger portion to receive the neck and a sloping portion to receive the head. The larger portion may contain an insert of hard material or an air bag. The United States patent to Jones, U.S. Pat. No. 655,087 shows an older form of pillow using an air bag in conjunction with softer material according to the technology of the times; e.g., feathers, down, etc. In Applicant's corresponding United States application, Ser. No. 520,775, filed Aug. 5, 1983 is disclosed a cylindrical air bag within a cylindrical sleeve of foamed material. This structure lacks provision for integrated head support. The pillows referred to above are somewhat complicated and difficult to manufacture. Other than Jones, however, they do employ resilient elastomer material. Greenawalt uses foamed material, such as urethane, but in the form of blocks of substantial size, together with other disadvantages inconsistent with an efficient and low-cost product. According to the present invention, an improved pillow is easily fabricated from a single rectangular sheet of foamed material folded upon itself or other configure to provide a hollow or sleeve-like member, the adjoining opposite ends of the sheet being adhered to each other and opposed portions or walls of the sheet being squeezed together in a limited area and adhered thereat, the remainder of the member being allowed to retain an expanded form so as to give the formed member somewhat of the shape of a pear lying on its side, having a large end providing a cavity at the expanded portion and a small or neck end at the wall portions adhered together. The cavity contains an air bag which is selectively inflatable to different degrees of firmness to support the neck of the user, the user's head resting on the downhill or neck portion of the "pear". The whole may be covered in a slip or casing of suitable material. A fill conduit for the air bag extends externally of the pillow and is equipped with an air pump of the releasable-check-valve type, such as used in equipment for checking blood pressure. The sheet is of uniform thickness and density throughout and the composite structure thus afforded is simple and inexpensive and lends itself admirably to the purposes intended.

DETAILED DESCRIPTION OF A PREFERRED EMBODIMENT

Figure 1:
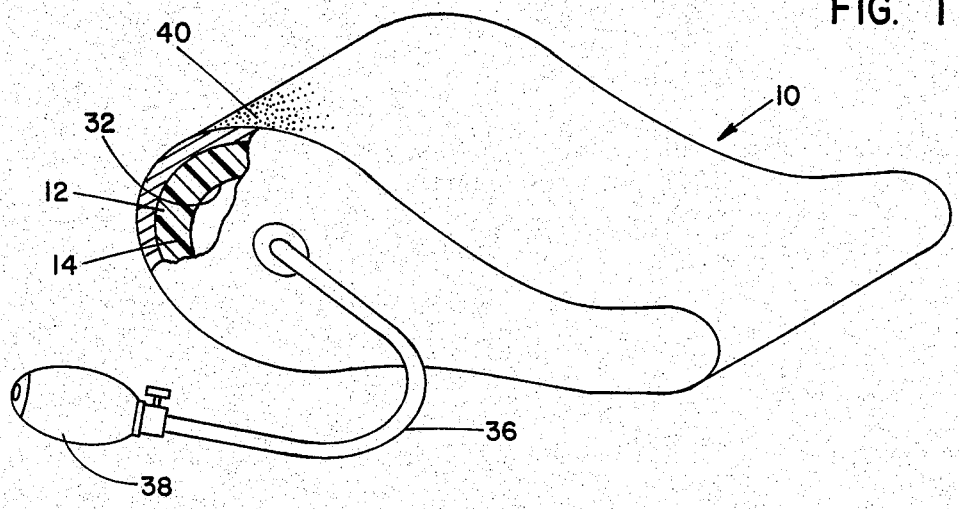
FIG. 1 is a perspective, with portions broken away and shown in section, of the improved pillow.
Figure 2:
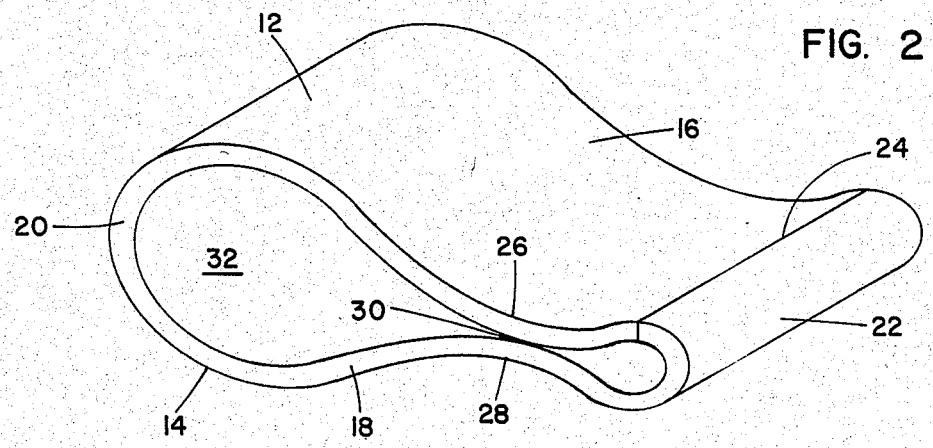
FIG. 2 is a similar perspective of the pear-shaped sleeve-like member per se.

The total pillow is designated in its entirety by the numeral (10) and is made up of a single sheet (12) of foamed, resilient material, such as urethane, folded or turned back upon itself to form a sleeve-like member (14) having upper and lower walls (16) and (18) and opposite end walls (20) and (22), all contiguous with each other. The sheet is preferably rectangular and of uniform thickness and density throughout and has its opposite ends brought together and glued together or otherwise joined, as along a line (24). This junction could exist anywhere within the bounds of the member.

Figure 4:
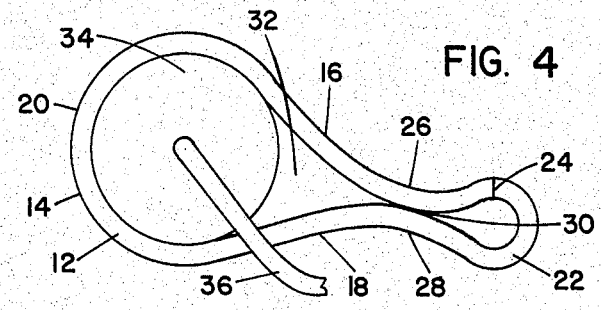
FIG. 4 is an end elevation showing the air bag within the cavity of the sleeve.
Figure 3:
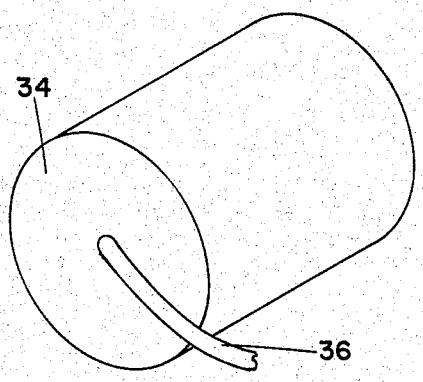
FIG. 3 is a perspective of one form of inflatable bag.

Reverse arcuate surfaces (26) and (28) of the upper and lower walls (16) and (18), respectively, are adhered to each other at (30). This arrangement provides for the pillow (10), in side elevation, to have a shape comprising a large partly cylindrical end (20) and a small partly cylindrical end (22), with the partly cylindrical ends being connected by the reverse arcuate surfaces (26) and (28) spherical shape. When in the non-used condition, the joined portions (26) and (28) have a concave formation in side elevation on both upper and lower sides as is best shown in FIG. 4. It will be noted in plan and end elevational views, the pillow (10) has a rectangular shape.

A cavity (32) is formed within the larger spherical end (20) within which is disposed an inflatable bag (34) having a fill conduit (36) extending exteriorly of the composite structure and equipped with a bulb or air pump (38) of the releasable-check-valve type such as used on equipment for checking blood pressure. This enables the user, while lying down, to inflate and deflate the bag at will, as distinguished from prior art structures in which the user must inflate by mouth and control a manual valve. The entire pillow may be enclosed within a suitable case or slip (40). The cavity (32) extends from side to side of the member (14) and is open at its opposite ends. The air bag will be retained in place by the cover or case (40).

Figure 5:
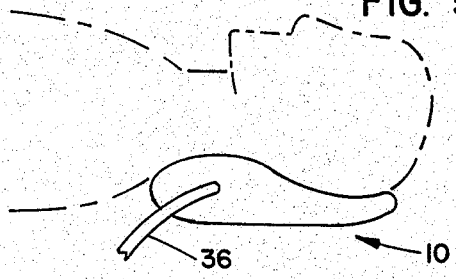
FIG. 5 is a small-scale view of the pillow in use, portions of the user being shown in dot-dash lines.

FIG. 5 depicts the typical use of the pillow, with the user's neck supported on the large spherical end of the pillow, which, as noted is filled and rendered relatively firm by the selectively inflated air bag, while the downhill portion of the pillow afforded by the junction (30) supports the user's head on a very much softer smaller spherical portion of the pillow. Of course, in use, the pillow occupies a position as shown in FIG. 5, with the bottom wall portion (18) flattened by the weight imposed on the pillow. It is to be noted that the cavity (32) is larger in cross-section than the air bag so that the upper wall of the member (14) is easily conformable to head shapes and sizes.

It will be seen from the foregoing that there has been provided a composite or posture pillow that is simple in construction, thus lending itself to the type of production that yields quality products at low cost. Virtually no maintenance of the pillow is required, save a periodic change of slip covers or pillow casings, as would be required in any case. The bulb-type pump affords a substantial convenience for the user or attendant to the user, as the case may be, because it enables selective adjustment of the firmness of the large end of the pillow while the user rests thereupon. Features and advantages not specifically pointed out will be apparent to those versed in the art, as will many modifications in the preferred embodiment disclosed, all of which may be achieved without departure from the spirit and scope of the invention.

I claim:

1. A posture pillow comprising:

(a) a single element of foamed resilient material having its ends joined together to form a hollow sleeve, upper and lower portions of said sleeve joined together to form, in side elevation, a shape having a large partly cylindrical end and a small partly cylindrical end, said cylindrical ends being connected by reverse arcuate surfaces, said large end having a larger radius than said small end and forming thereby a cavity within said large end; and (b) an inflatable bag disposed within said cavity.

2. A pillow according to claim 1, including a conduit connected to the bag and extending exteriorly of the element for adjustably inflating the bag.

3. A pillow according to claim 2, including an air pump connected to the conduit.

4. A pillow according to claim 3, in which the pump is of the releasable-check-valve type.

5. A pillow according to claim 1, in which the sheet is rectangular and has its opposite ends joined together to form the sleeve-like configuration of the element.

6. A pillow according to claim 1, in which the sheet is of uniform thickness thoughout.

7. A pillow according to claim 6, in which the sheet is also of uniform density thoughout.

8. A pillow according to claim 1, in which the cavity is substantially larger than the inflatable air bag in cross-section.

* * * * *